US006464477B1

(12) United States Patent
Wu

(10) Patent No.: US 6,464,477 B1
(45) Date of Patent: Oct. 15, 2002

(54) RETAINING DEVICE FOR A PIVOTABLE HANDLE OF A HAND PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/864,560

(22) Filed: May 23, 2001

(51) Int. Cl.[7] ..... F04B 39/10; F04B 39/00; F01B 31/00

(52) U.S. Cl. ..... 417/569; 417/572; 92/58.1

(58) Field of Search ..... 417/569, 572; 92/58.1

(56) References Cited

U.S. PATENT DOCUMENTS 2,536,083 A * 1/1951 Peters et al. ..... 16/438
2,677,975 A * 5/1954 Russell ..... 74/547
3,966,364 A * 6/1976 Bachle et al. ..... 417/539
5,494,411 A * 2/1996 Chuang ..... 417/234
5,534,145 A * 7/1996 Platter et al. ..... 210/130
5,715,554 A * 2/1998 Downs et al. ..... 152/415

* cited by examiner

*Primary Examiner*—Charles G. Freay
*Assistant Examiner*—Timothy P. Solak
(74) *Attorney, Agent, or Firm*—Alan D. Kamrath; Rider, Bennett, Egan & Arundel

(57) ABSTRACT

A hand pump includes a cylinder, a head attached to an end of the cylinder, and a reciprocating member having an end slidably received in the cylinder. A retaining member is securely attached to the other end of the reciprocating member to move therewith and includes a supporting face. A handle is pivotally mounted to the retaining member and movable between a storage position and an operative position for inflation. When moving the handle from the storage position to the operative position, the handle is pivoted relative to the retaining member through an angle not less than 180 degrees and then supported by the supporting face of the retaining member.

20 Claims, 7 Drawing Sheets

RETAINING DEVICE FOR A PIVOTABLE HANDLE OF A HAND PUMP

BACKGROUND OF THE INVENTION

1. Field of the Invention

The present invention relates to a retaining device for a pivotable handle of a hand pump, and more particularly to a pivotable handle of a hand pump that can be retained in place during inflation.

2. Description of the Related Art

FIG. 7 of the drawings illustrates a conventional hand pump comprising a cylinder 1, a piston 3, and a handle 2 that is pivotally connected to an end of the piston 3. The handle 2 can be pivoted to a storage position for saving space when not in use. It was, however, found that the handle 2 was not retained in its operative position during inflation and thus unable to provide a smooth inflating operation.

SUMMARY OF THE INVENTION

It is an object of the present invention to provide a pivotable handle of a hand pump that can be retained in place during inflation.

A hand pump in accordance with the present invention comprises a cylinder, a head attached to an end of the cylinder, and a reciprocating member having an end slidably received in the cylinder. A retaining member is securely attached to the other end of the reciprocating member to move therewith and includes a supporting face. A handle is pivotally mounted to the retaining member and movable between a storage position and an operative position for inflation. When moving the handle from the storage position to the operative position, the handle is pivoted relative to the retaining member through an angle not less than 180 degrees and then supported by the supporting face of the retaining member.

In an embodiment of the invention, the handle comprises two spaced lugs at an end thereof. A pin is extended through aligned holes of the lugs and the retaining member, thereby pivotally mounting the handle to the retaining member. The retaining member comprises a recessed portion having an upwardly facing bottom that acts as the supporting face for supporting the handle. An end wall is defined between the lugs and supported by the upwardly facing bottom of the retaining member when the handle is in its operative position. The retaining member further comprises an engaging groove. The end wall of the handle comprises a rib for releasably engaging with the engaging groove when the handle is in its operative position.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
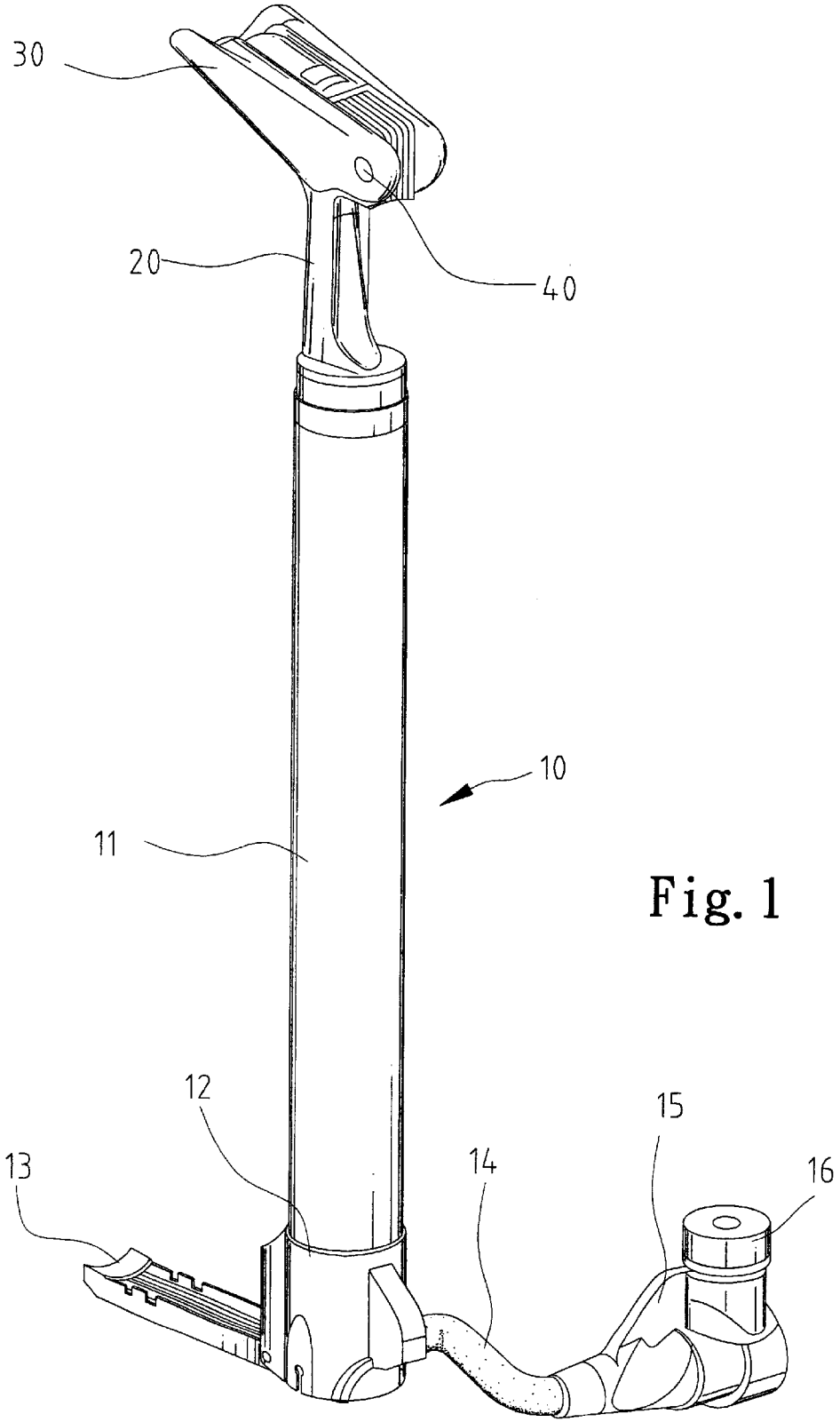
FIG. 1 is a perspective view of a hand pump in accordance with the present invention.
Figure 2:
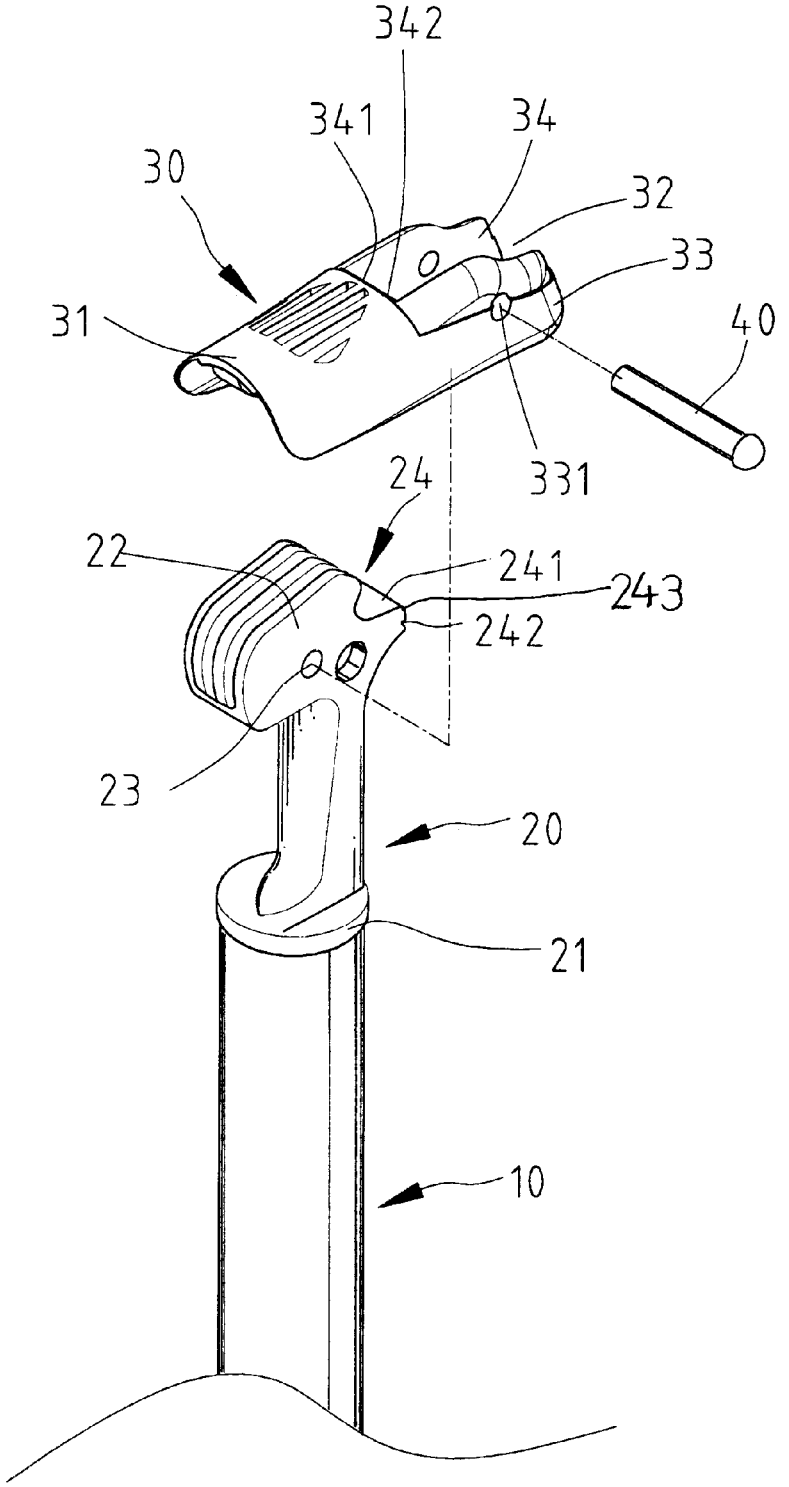
FIG. 2 is an exploded perspective view of an upper portion of the hand pump in accordance with the present invention.
Figure 3:
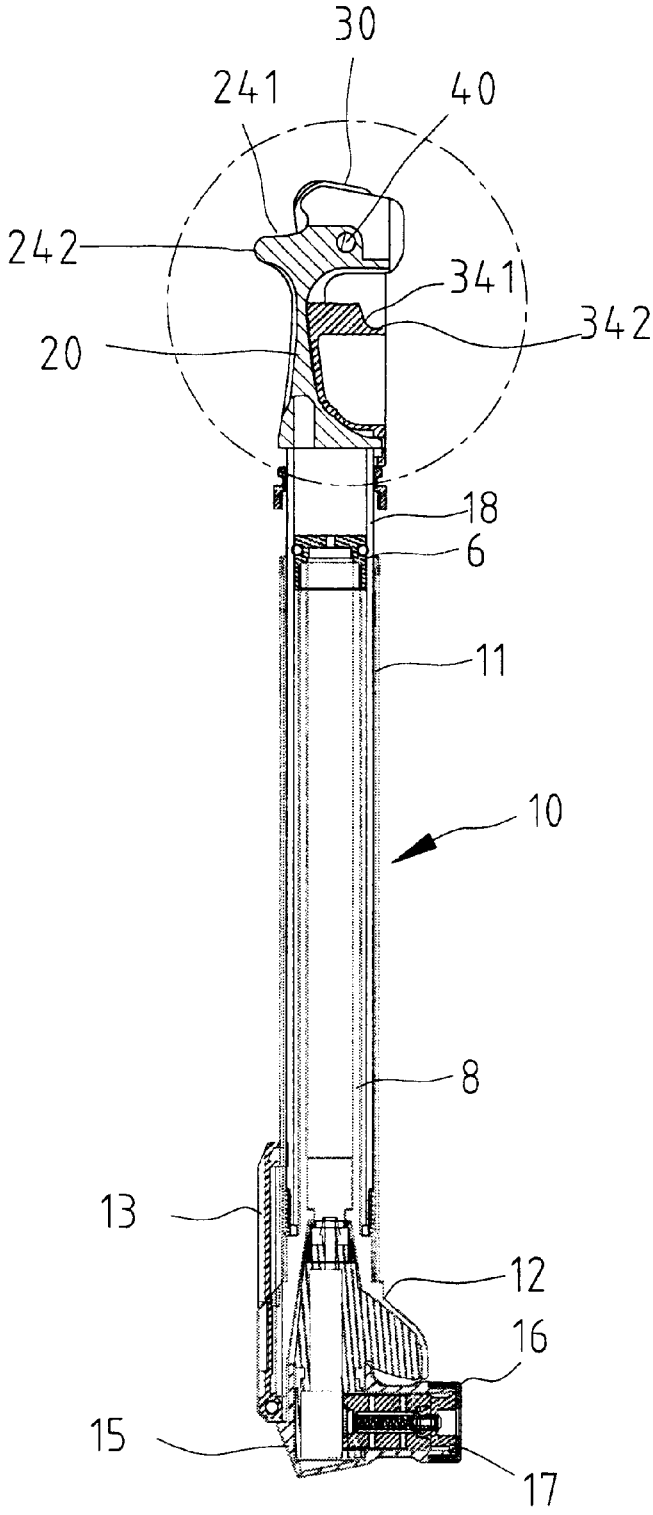
FIG. 3 is a sectional view of the hand pump in accordance with the present invention, wherein the handle is in a storage position.

Referring to FIGS. 1 through 6 and initially to FIGS. 1 through 3, a hand pump 10 in accordance with the present invention generally includes a cylinder 11, a tubular reciprocating member 18, a head 12, a retaining member 20, and a handle 30. The head 12 is securely attached to a lower end of the cylinder 11 and communicated with a nozzle head 15 via a hose 14. A pedal 13 includes an end pivotally connected to a lower end of the head 12. A nozzle 17 is mounted in the nozzle head 15 and an end cap 16 is mounted to the nozzle head 15 and thus encloses the nozzle 17, best shown in FIG. 3.

The reciprocating member 18 includes an end slidably received in the cylinder 11. The retaining member 20 is securely attached to the other end of the reciprocating member 18. A fixed rod 8 is received in the tubular reciprocating member 18 and includes a first end securely attached to the head 12 and a second end to which a piston 6 is securely mounted. The handle 30 is pivotally mounted to the retaining member 20. Thus, inflation can be achieved by means of operating the handle 30 in an operative position. It is noted that the structure and operation of the hand pump shown in FIGS. 1 through 3 is conventional and therefore not described in detail. It is further noted that the retaining member 20 and the handle 30 can also be applied to hand pumps of other types.

Of more importance, the retaining member 20 includes a lateral pivot hole 23 (FIG. 2) and a recessed portion 24. The recessed portion 24 includes an upwardly facing bottom that acts as a supporting face and an engaging face 243 below the supporting face 241. In this embodiment, the engaging face 243 includes an engaging groove 242, best shown in FIGS. 2 and 4. The handle 30 includes a first end 31 and a second end 32 having two spaced lugs 33, thereby defining a space 34 between the lugs 33. The space 34 is greater than a width of the retaining member 20. A pin 40 is extended through the pivotal hole 23 of the retaining member 20 and aligned holes 331 of the lugs 33, thereby pivotally mounting the handle 30 to the retaining member 20. An end wall 341 between the lugs 33 has a rib 342 for releasably engaging with the engaging groove 242 of the retaining member 20, best shown in FIG. 6.

Figure 4:
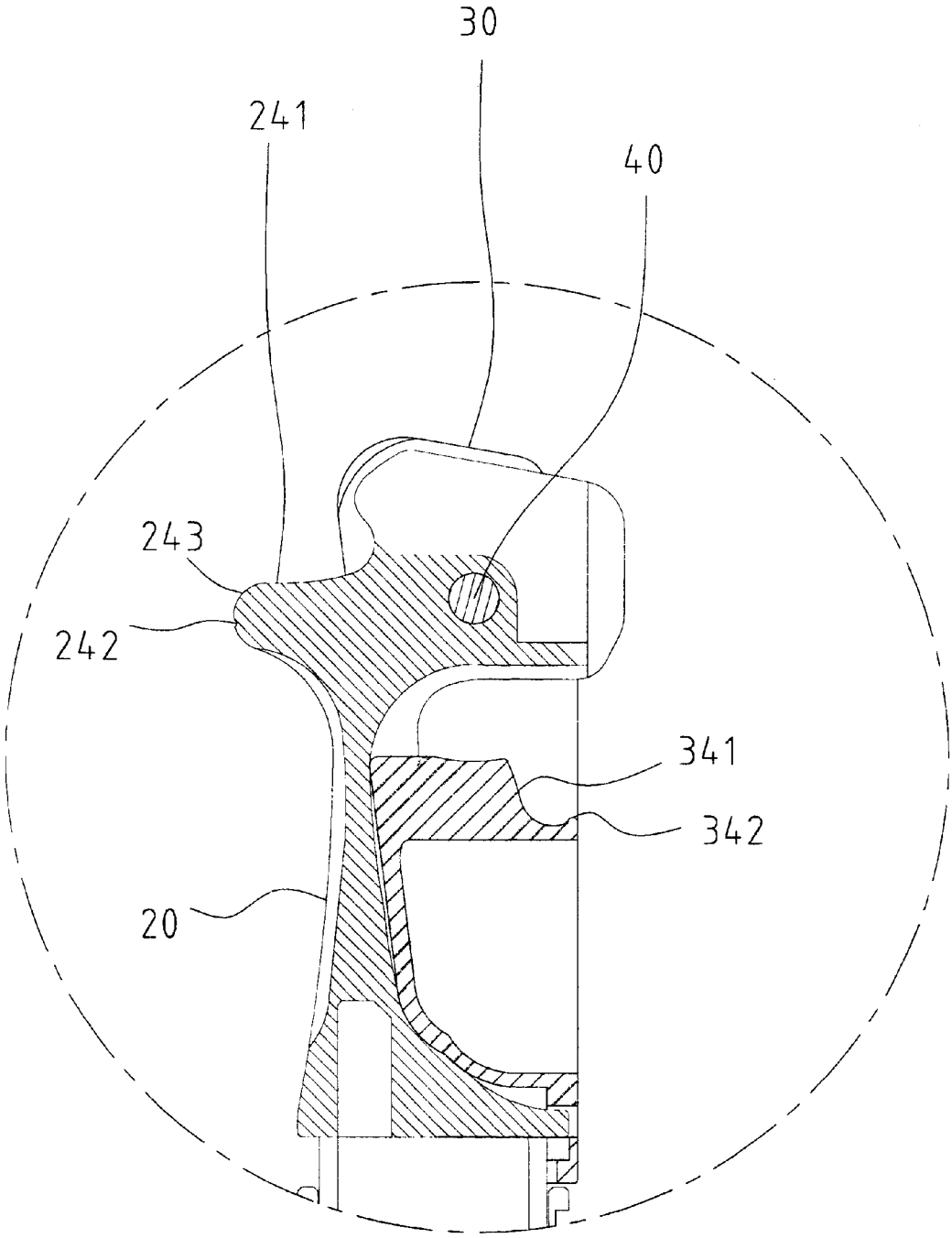
FIG. 4 is an enlarged view of a circle in FIG. 3.
Figure 5:
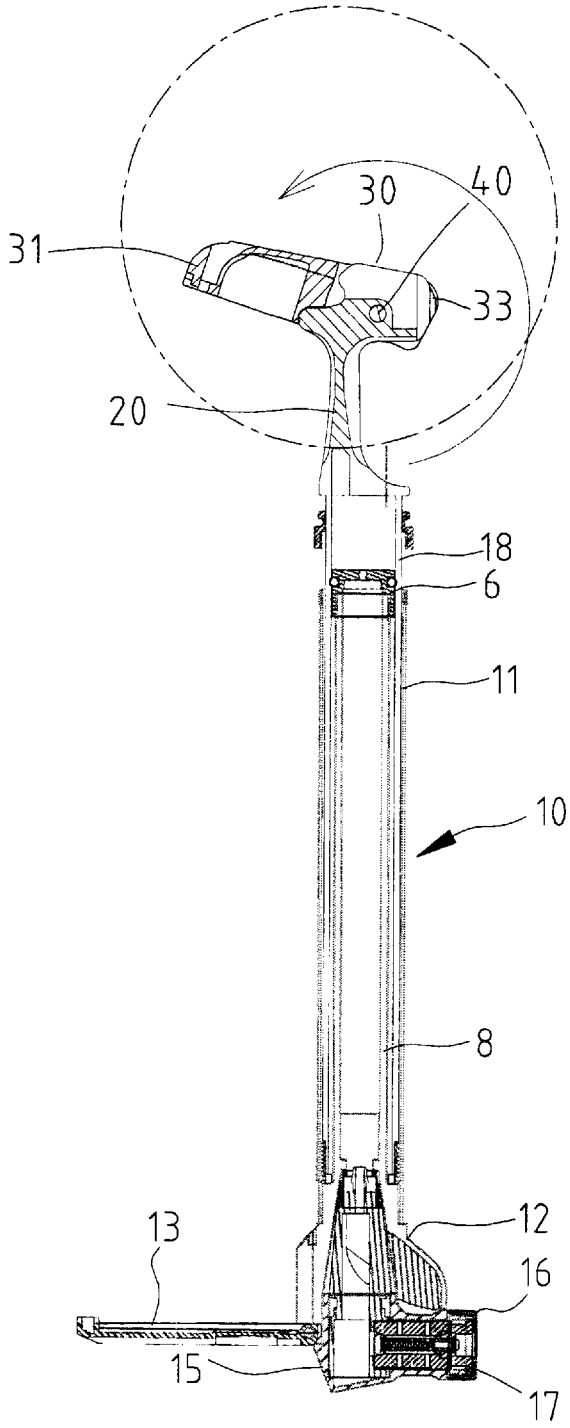
FIG. 5 is a sectional view similar to FIG. 3, wherein the handle is in an operative position.
Figure 6:
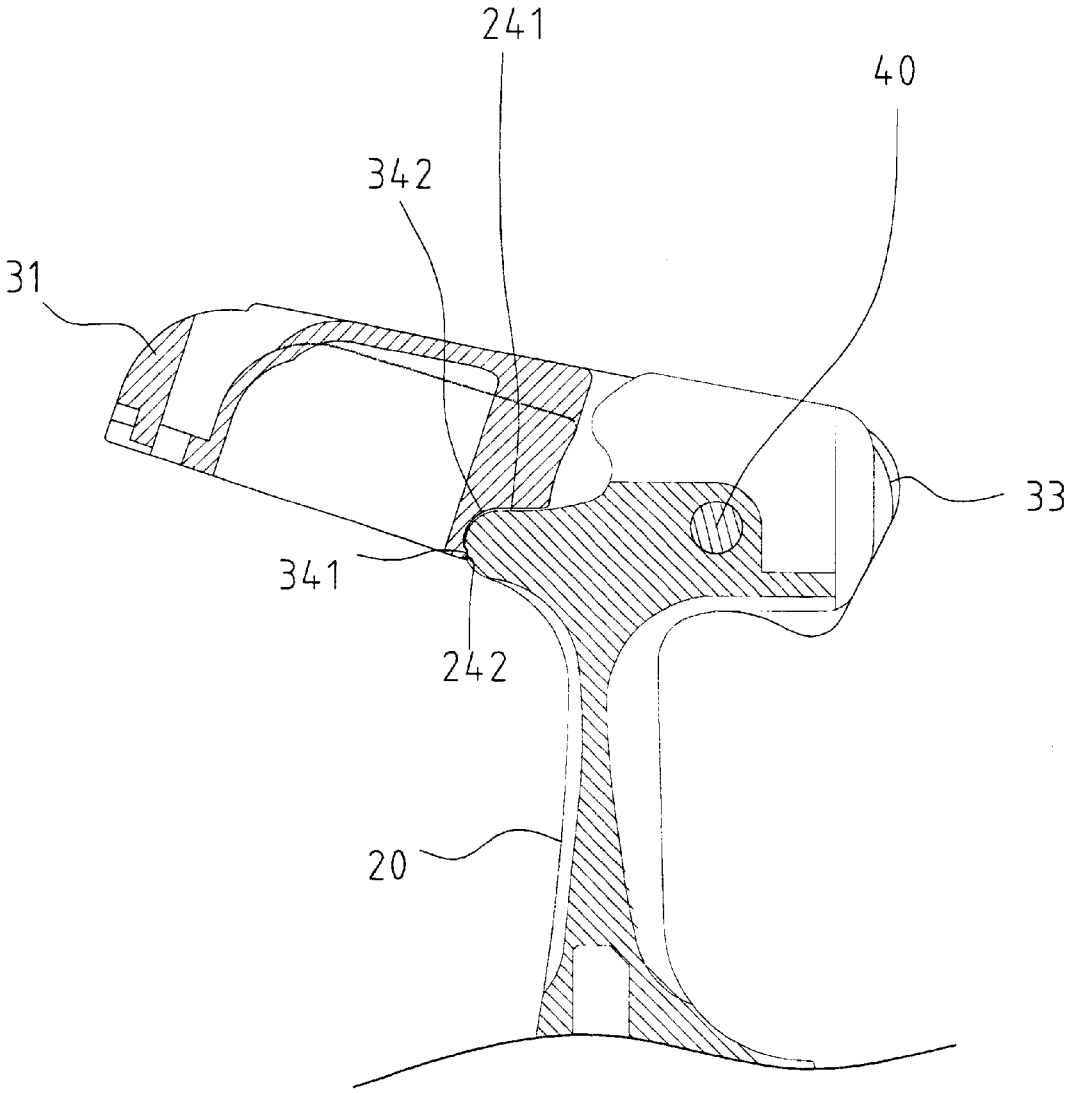
FIG. 6 is an enlarged view of a circle in FIG. 5.
Figure 7:
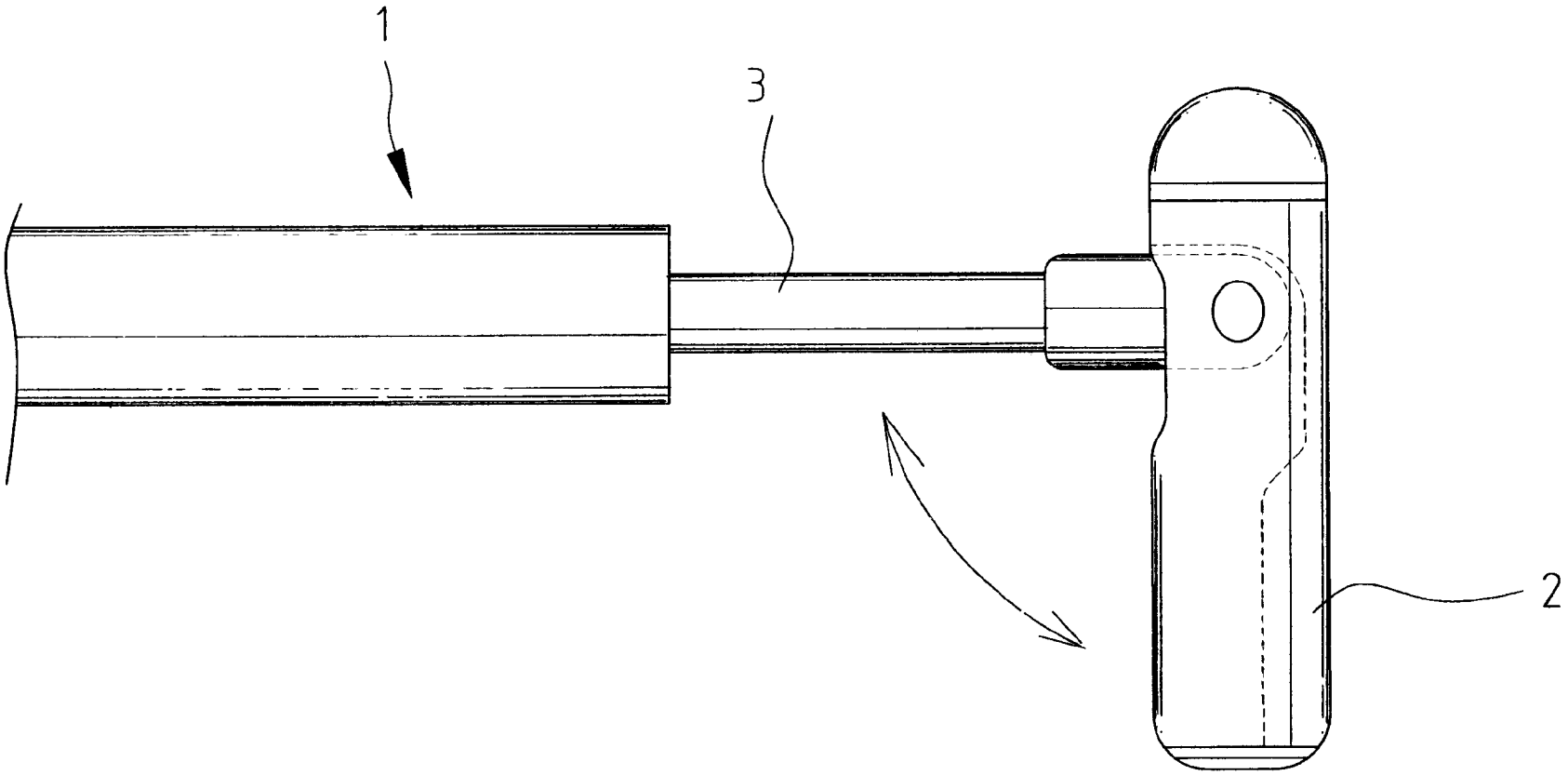
Fig. 7 PRIOR ART
FIG. 7 is a schematic side view of a conventional hand pump.

When not in use, the handle 30 is in its storage position in which the handle 30 lies on a plane that is substantially parallel to a longitudinal direction of the cylinder 11, thereby saving space, best shown in FIGS. 3 and 4. In use, as illustrated in FIG. 5, the handle 30 is pivoted relative to the retaining member 20 through an angle not less than 180 degrees (270 degrees in this embodiment) until the end wall 341 of the handle 30 rests on the upwardly facing supporting face 241 of the retaining member 20. Thus, the handle 30 can be retained in place during inflation operation. In addition, the rib 342 of the handle 30 is engaged in the engaging groove 242 of the retaining member 20 to thereby further assure the required retaining effect for the handle 30.

Thus, the present invention provides a retaining device for retaining the handle 30 in place during inflation. Nevertheless, it is noted that the retaining device in accordance with the present invention can be applied to all kinds of hand pumps, not limited to the hand pump shown in FIGS. 1 through 6.

Although the invention has been explained in relation to its preferred embodiment, it is to be understood that many other possible modifications and variations can be made without departing from the scope of the invention as hereinafter claimed.

What is claimed is:

1. A hand pump comprising:

a cylinder including a first end and a second end;

a head attached to the first end of the cylinder;

a reciprocating member having a first end slidably received in the cylinder and a second end;

a retaining member securely attached to the second end of the reciprocating member to move therewith, the retaining member including a supporting face; and a handle pivotally mounted to the retaining member and movable between a storage position substantially parallel to the cylinder and an operative position for inflation substantially perpendicular to the cylinder;

wherein when moving the handle from the storage position to the operative position, the handle is pivoted relative to the retaining member in a pivotal direction through an angle greater than 180 degrees and then supported by the supporting face of the retaining member to prevent the handle from pivoting beyond the operative position in the pivotal direction.

2. The hand pump as claimed in claim 1, wherein the handle comprises two spaced lugs at an end thereof, the spaced lugs having aligned holes, a pin extending through the aligned holes of the lugs and the retaining member, thereby pivotally mounting the handle to the retaining member.

3. The hand pump as claimed in claim 2, wherein the retaining member comprises a recessed portion having an upwardly facing bottom that acts as the supporting face for supporting the handle.

4. The hand pump as claimed in claim 3, wherein the retaining member further comprises an engaging groove, the handle comprising a rib for releasably engaging with the engaging groove when the handle is in its operative position.

5. The hand pump as claimed in claim 3, wherein the lugs have an end wall therebetween, the end wall being supported by the upwardly facing bottom of the retaining member when the handle is in its operative position.

6. The hand pump as claimed in claim 5, wherein the retaining member further comprises an engaging groove, the end wall of the handle comprises a rib for releasably engaging with the engaging groove when the handle is in its operative position.

7. The hand pump as claimed in claim 1, wherein the head comprises a pedal pivotally mounted thereto.

8. A hand pump comprising:

a cylinder including a first end and a second end;

a head attached to the first end of the cylinder;

a reciprocating member having a first end slidably received in the cylinder and a second end;

a retaining member securely attached to the second end of the reciprocating member to move therewith, the retaining member including a supporting face; and a handle pivotally mounted to the retaining member and movable between a storage position and an operative position for inflation;

wherein when moving the handle from the storage position to the operative position, the handle is pivoted relative to the retaining member through an angle not less than 180 degrees and then supported by the supporting face of the retaining member, wherein the retaining member comprises a recessed portion having an upwardly facing bottom that acts as the supporting face for supporting the handle.

9. The hand pump as claimed in claim 8, wherein the retaining member further comprises an engaging groove, the handle comprising a rib for releasably engaging with the engaging groove when the handle is in its operative position.

10. The hand pump as claimed in claim 8, wherein the handle comprises two spaced lugs at an end thereof, the spaced lugs having aligned holes, a pin extending through the aligned holes of the lugs and the retaining member, thereby pivotally mounting the handle to the retaining member.

11. The hand pump as claimed in claim 10, wherein the lugs have an end wall therebetween, the end wall being supported by the upwardly facing bottom of the retaining member when the handle is in its operative position.

12. The hand pump as claimed in claim 11, wherein the retaining member further comprises an engaging groove, the end wall of the handle comprises a rib for releasably engaging with the engaging groove when the handle is in its operative position.

13. The hand pump as claimed in claim 12, wherein the head comprises a pedal pivotally mounted thereto.

14. A hand pump comprising:

a cylinder including a first end and a second end;

a head attached to the first end of the cylinder;

a reciprocating member having a first end slidably received in the cylinder and a second end;

a retaining member securely attached to the second end of the reciprocating member to move therewith, the retaining member including a supporting face; and a handle pivotally mounted to the retaining member and movable between a storage position and an operative position for inflation;

wherein when moving the handle from the storage position to the operative position, the handle is pivoted relative to the retaining member through an angle not less than 180 degrees and then supported by the supporting face of the retaining member, wherein the retaining member further comprises an engaging groove, the handle comprising a rib for releasably engaging with the engaging groove when the handle is in its operative position.

15. The hand pump as claimed in claim 14, wherein the handle comprises two spaced lugs at an end thereof, the spaced lugs having aligned holes, a pin extending through the aligned holes of the lugs and the retaining member, thereby pivotally mounting the handle to the retaining member.

16. The hand pump as claimed in claim 15, wherein the lugs have an end wall therebetween, the end wall being supported by the upwardly facing bottom of the retaining member when the handle is in its operative position.

17. The hand pump as claimed in claim 16, wherein the head comprises a pedal pivotally mounted thereto.

18. The hand pump as claimed in claim 14, wherein the retaining member comprises a recessed portion having an upwardly facing bottom that acts as the supporting face for supporting the handle.

19. The hand pump as claimed in claim 18, wherein the handle comprises two spaced lugs at an end thereof, the spaced lugs having aligned holes, a pin extending through the aligned holes of the lugs and the retaining member, thereby pivotally mounting the handle to the retaining member.

20. The hand pump as claimed in claim 19, wherein the lugs have an end wall therebetween, the end wall being supported by the upwardly facing bottom of the retaining member when the handle is in its operative position.

* * * * *